US005960851A

United States Patent [19]

Donahue

[11] Patent Number: 5,960,851

[45] Date of Patent: Oct. 5, 1999

[54] METHOD OF LOST FOAM CASTING OF ALUMINUM-SILICON ALLOYS

[75] Inventor: Raymond J. Donahue, Fond du Lac, Wis.

[73] Assignee: Brunswick Corporation, Lake Forest, Ill.

[21] Appl. No.: 09/128,655

[22] Filed: Aug. 4, 1998

[51] Int. Cl.[6] ..... B22C 7/02; B22C 9/04

[52] U.S. Cl. ..... 164/34; 164/246; 164/235; 164/45

[58] Field of Search ..... 164/34, 45, 46, 164/235, 246, 253; 508/236, 241, 291; 525/301

[56] References Cited

U.S. PATENT DOCUMENTS

| | | | |
|---|---|---|---|
| 2,983,692 | 5/1961 | D'Aiello . | |
| 4,633,929 | 1/1987 | Santangelo et al. | 164/34 |
| 4,773,466 | 9/1988 | Cannarsa et al. | 164/45 |
| 4,907,638 | 3/1990 | Hubbell et al. | 164/45 |
| 4,951,733 | 8/1990 | Kusche et al. | 164/34 |
| 4,966,220 | 10/1990 | Hesterbeg et al. | 164/34 |
| 4,969,428 | 11/1990 | Donahue et al. | 123/195 |
| 5,035,276 | 7/1991 | Corbett et al. | 164/34 |
| 5,038,847 | 8/1991 | Donahue et al. | 164/112 |
| 5,088,545 | 2/1992 | Corbett | 164/246 |
| 5,111,869 | 5/1992 | Corbett et al. | 164/235 |
| 5,119,882 | 6/1992 | Corbett et al. | 164/246 |
| 5,121,787 | 6/1992 | Corbett et al. | 164/34 |
| 5,290,373 | 3/1994 | Donahue et al. | 148/549 |
| 5,355,930 | 10/1994 | Donahue et al. | 164/34 |
| 5,518,060 | 5/1996 | Cleary et al. | 164/45 |

OTHER PUBLICATIONS

"Mercosil Engine Block Technology", Donahue et al, 2nd International Conference, High Performance Spark Ignition Engines For Passenger Cars. Paper I.D.: ATA 95A6019, Nov. 23–34, 1995, Italy.

*Primary Examiner*—Patrick Ryan
*Assistant Examiner*—Anjan Dey
*Attorney, Agent, or Firm*—Andrus,Sceales, Starke & Sawall

[57] ABSTRACT

An improved method of lost foam casting of aluminum silicon alloys utilizing a pattern formed of an expandable polymeric foam having a decomposition temperature less than 300° C., and a heat of decomposition less than 600 Joules per gram. The foam pattern preferably has a heat of fusion less than 60 Joules per gram and a bulk density in the range of one to four pounds per cubic foot. The lost foam casting procedure has particular use when casting hypereutectic aluminum silicon alloys containing from 16 to 30% silicon, and eliminates the "liquid styrene" defect which occurs when casting such alloys in a lost foam process utilizing conventional polystyrene foam patterns. When casting hypoeutectic aluminum-silicon alloys containing from 5% to 8% silicon, the method eliminates the "fold" defect.

12 Claims, No Drawings

METHOD OF LOST FOAM CASTING OF ALUMINUM-SILICON ALLOYS

BACKGROUND OF THE INVENTION

Lost foam casting, also known as evaporable foam casting, is a conventional casting method in which a pattern is formed of an evaporable polymeric foam material having a configuration substantially identical to the part to be cast. The foam pattern is normally coated with a ceramic wash material which prevents metals and reaction and facilitates cleaning of the cast metal part. The pattern containing the wash coating is supported in a mold and surrounded by an unbonded particulate material such as sand. During casting, when the molten metal contacts the pattern, the foam material in various fractions, melts, vaporizes and decomposes with the liquid and vapor products of the degradation passing through the porous wash coating and into the interstices of the sand, while the molten metal replaces the void created by displacement of the foam material to thereby form a cast article identical in shape to the pattern.

The use of lost foam casting is particularly useful when casting large articles of complex configuration, such as cylinder blocks for internal combustion engines. In the past, polystyrene has been most commonly used in producing foam patterns for lost foam casting and polymethylmethacrylate has seen some limited use. In addition, U.S. Pat. Nos. 4,633,929 and 4,773,466 describe the use of polyalkylene carbonate foam in producing iron castings.

Aluminum silicon alloys containing less than about 11.6% by weight of silicon are referred to as hypoeutectic alloys and have seen extensive use in the past. The unmodified alloys have a microstructure consisting of primary aluminum dendrites, with a eutectic composed of acicular silicon in an aluminum matrix.

On the other hand, aluminum silicon alloys containing more than about 11.6% silicon are referred to as hypereutectic alloys and contain primary silicon crystals, which are precipitated as the alloy is cooled between the liquidus temperature and the eutectic temperature. Due to the high hardness of the precipitated primary silicon crystals, these alloys have better wear-resistance than the hypoeutectic alloys, but have a relatively large or wide solidification range. The solidification range, which is the temperature range over which the alloy will solidify, is the range between the liquidus temperature and the invariant eutectic temperature. The wider the solidification range, the longer it will take for an alloy to solidify at a given rate of cooling. For casting purposes, a narrow solidification range is normally desired.

It is also recognized that hypereutectic aluminum silicon alloys are more difficult to cast than hypoeutectic aluminum silicon alloys, because hypereutectic alloys are difficult to "feed", and this casting characteristic worsens as the silicon content is increased.

Hypereutectic aluminum silicon alloys are inherently difficult to cast using lost foam casting processes because of the flotation of the primary silicon crystals during slow cooling, and because of the difficulty of feeding metal shrinkage during slow cooling that results due to the wide solidification range of these alloys. As a further problem, hypereutectic aluminum silicon alloys produced by lost foam casting utilizing polystyrene foam patterns often contain defects resulting from trapped liquid foam transformation products, defects commonly referred to as "liquid styrene defects". These defects appear as elongated rifts, and may extend either partially or through the entire thickness of the casting.

It is believed that the "liquid styrene defects" result because the liquid styrene that accumulates on the advancing molten metal front remains a liquid longer than the metal, particularly when two molten metal streams meet in the far reaches of a complex casting, and have lost a significant portion of their initial super heat. Even after solidification, the solidified metal continues to transfer heat to the liquid styrene, eventually causing its evaporation and creating a void in the space previously occupied by the liquid styrene. With castings such as engine blocks which are subjected in use to high internal pressures, leakage can occur through the defects.

In certain cases, repair welding can be utilized to repair visible "liquid styrene defects", but this is an expensive procedure and is not an option where the defects are internal and not visible. Even when the defects do not penetrate the entire casting thickness and thus do not impair the functionality of the casting, the defects greatly degrade the aesthetics of the casting surface and hinder the acceptance of the casting in any market that cannot tolerate a roughened skin appearance.

Numerous attempts have been made in the past to eliminate the "liquid styrene defect". One attempt was to use expanded polystyrene foam of a lower density. Typical expanded polystyrene foam as used in lost foam casting has a bulk density of about 1.6 pounds/cubic foot, and it was thought that by using a polystyrene foam of lesser density, i.e. 1 pound per cubic foot, a lesser volume of decomposition products would be produced, which theoretically could minimize the defects. However, the use of lesser density polystyrene foam did little to eliminate the defects in hypereutectic aluminum silicon casting.

It was also suggested to cast the hypereutectic aluminum silicon alloys at higher temperatures to allow more time for the liquid styrene to be transported out of the casting. Like the use of low density expanded polystyrene foam, the higher casting temperature did not result in a solution for the "liquid styrene defect".

It was also suggested to use a wash coating on the polystyrene pattern which was more porous or permeable. Again, the use of a more porous coating did not reduce the "liquid styrene defects" in casting of the hypereutectic aluminum silicon alloys.

It was also proposed to use heated sand at a temperature of 150° F. which would facilitate more effective wetting and wicking of the liquid styrene into the coating. Again, this was not effective in solving the defect.

In summary there has been a distinct need for a solution to the "liquid styrene defect" which occurs when casting hypereutectic aluminum silicon alloys using polystyrene foam patterns in a lost foam casting process.

It has also been recognized that defects can occur when casting hypoeutectic aluminum silicon alloys using lost foam techniques. The most serious defect, characteristic of the hypoeutetcic aluminum-silicon alloys is the "fold" defect.

This defect, unlike the liquid styrene defect of the hypereutectic aluminum-silicon alloys, basically has carbonaceous, pyrolyzed, decomposed foam products trapped (i.e. sandwiched) between a folded over oxide film and at the surface of the casting does not impair the aesthetics of the casting.

SUMMARY OF THE INVENTION

The invention is directed to an improved method of lost foam casting aluminum-silicon alloys utilizing a pattern formed of a polymeric foam having a decomposition temperature less than 300° C. and a heat of decomposition less than 600 Joules per gram. It is also preferred that the polymeric foam pattern have a heat of fusion less than 60 Joules per gram and a heat capacity of less than 1.6 Joules per gram per degree K. at 54° C. and less than 2.1 Joules per gram per degree K. at 127° C. The invention has particular use in casting hypereutectic aluminum silicon alloys of complex configurations, such as internal combustion engine blocks.

The foam pattern is produced by conventional injection molding techniques, and has a configuration which is substantially identical to that of the article to be cast. The preferred material to be used in forming the foam pattern is polyalkylene carbonate, which has a decomposition temperature of 254.9° C., a heat of decomposition of 483.8 Joules per gram, a heat of fusion of 20.4 Joules per gram, and a heat capacity of 1.54 Joules per gram per degree K. at 54° C. and 2.01 Joules per gram per degree K. at 127° C. The bulk density of the foam pattern is not critical and can be in the range of about 1.0 pounds per cubic foot to 4.0 pounds per cubic foot.

The pattern is coated with a conventional porous ceramic material which acts to prevent metal/sand reaction and facilitates cleaning of the cast metal part.

The invention has particular use in casting hypereutectic aluminum silicon alloys which contain from 16% to 30% by weight silicon, 0.3 to 1.5% magnesium, up to 4.5% by weight of copper, and the balance aluminum. The pattern can also be used in casting hypoeutectic aluminum-silicon alloys which contain 5% to 8% by weight silicon, 0.3% to 0.5% magnesium, up to 4.5% by weight of copper, and the balance aluminum.

In the casting process, the foam pattern having a configuration identical to the part to be cast, is placed in a mold or flask and surrounded by a flowable inert material, such as sand. The sand also fills any voids or cavities in the pattern. The molten metal is then fed through a sprue into contact with the pattern, and the heat of the molten metal will melt, vaporize and decompose the polymer in various fractions with the products of decomposition passing through the porous ceramic coating and into the interstices of the surrounding sand. The molten metal will occupy the void created by vaporization of the pattern to produce a cast metal article substantially identical in configuration to the pattern.

It has been discovered that the polyalkylene carbonate foam pattern, having the above mentioned physical properties, will prevent a "liquid polymer defect" when casting hypereutectic aluminum silicon alloys in a lost foam process. As the polyalkylene carbonate pattern has a low decomposition temperature and low heat of decomposition and relatively low heat of fusion, it will absorb less heat from the molten metal front to improve the fluidity of the molten metal, thus preventing entrapment of liquid decomposition products in prematurely solidified metal. For hypoeutectic aluminum-silicon alloys, the same properties for polyalkylene carbonate favor a lower residence time that the liquid polymer is in contact with the folded over oxide film. It is believed the shorter residence will not allow pyrolysis of the liquid to occur before gasification. Therefore, "fold" type defects in the hypoeutectic alloy will be minimized.

As previously noted, the density of the polyalkylene carbonate foam pattern to be used in the invention is not critical, and can vary from about 1.0 pounds per cubic foot to 4.0 pounds per cubic foot. Thus, higher density foams can be used to advantage to facilitate mechanical strength and integrity of the foam pattern to avoid distortion and handling damage.

Other objects and advantages will appear during the course of the following description.

DESCRIPTION OF THE PREFERRED EMBODIMENT

It has been found that during a lost foam casting process, a clear measure of the heat loss from the metal stream as the foam material is being displaced can be obtained by measuring the maximum temperature recorded by thermocouples inserted in the foam. The experimental maximum temperature in a runner system versus distance from the sprue can be compared against a calculated temperature profile using the thermodynamic properties of the foam and metal to verify the correctness of the model that is used in the lost foam casting process to explain defects that may be encountered in the foam. By contrast, measuring only the pouring temperature tells the metal caster very little about temperature of the metal front inside the casting where defects, such as misruns or trapped liquid styrene, may be forming.

The total heat extracted from an advancing metal stream (by one cubic inch of polystyrene) as the foam material, in various fractions, melts, is heated to its boiling point, vaporizes and/or decomposes (with the liquid and vapor products of the degradation passing through the porous wash coating) can be calculated with the following equation:

$$\text{Heat extracted}=f_L[(\text{heat of fusion}\times wt)+(\text{specific heat})\times\Delta T\times wt]+f_v[(\text{heat of fusion}\times wt)+(\text{specific heat})\times\Delta T\times wt+(\text{heat of decomposition}^*\times wt)]$$

* or heat of polymerization or heat of vaporization where:

$f_L$ is the liquid fraction and assumed to be 0.75 (based on experimental findings of Charles Bates and Harry Littleton, UAB, private communcation)

$f_v$ is the fraction that vaporizes, and/or decomposes and assumed to be 0.25 (based on experimental findings of Charles Bates and Harry Littleton, UAB, private communication)

heat of fusion (polystyrene)=80.36 Joules per gram (from R. Dedourwaerder, J. F. M. Oth, J. Chim. Phys., 56,940 (1959) and Polymer Handbook, published by John Wiley & Sons (1989)

wt=weight of foam=0.42 gram (i.e. weight of 1 $in^3$ of polystyrene of 1.6 $lb/ft^3$density) specific heat (polystyrene)=1.2 Joules per gram per ° K. at 27° and 1.9 Joules per gram per ° K. at 127° C. (from "Styrene, It's Polymers, Copolymers and Derivatives", Reinhold Publishing Corp., New York, 1952 and "Polymer Handbook", John Wiley & Sons, New York, 1989)

ΔT=420° C. (vaporization temperature) minus 20° C. (room temperature)

heat of decomposition=876 Joules per gram (Don Ashkaland, Paper 92–111, 96th AFS Casting Congress, May 3–7, 1992))

heat of polymerization=647 Joules per gram (Polymer Handbook, John Wiley & Sons, New York, 1989)

The total extracted heat, in the above case, 444 Joules (or 421 Joules if the heat of polymerization is used), from one cubic inch of polystyrene, lowers the temperature of a hypereutectic aluminum-silicon alloy of 19% silicon (which has a density of 2.4 gram per $cm^3$, and specific heat of 1.055 Joules per gram per degrees C) by 10.7° C. (or 10.2° C. if the heat of polymerization is used). If the cross section of the runner is one square inch, then the slope of the "maximum metal temperature vs. distance from the sprue" curve calculates to be 10.7° C. per inch. This compares favorably with the experimental slope of 11.1° C. per inch, obtained from a 200° C. 6 temperature drop over an 18 inch length segment of a runner system with a one square inch section. By contrast, if all of the polystyrene vaporizes, the temperature vs. distance slope would calculate to be 17.4° C. per inch (or 15.1° C. per inch if the heat of polymerization is used).

Thus, these calculations support the premise that 75% of the liquid styrene leaves the foam-filled cavity through the porous wash coating on the foam, and that this liquid styrene leaves through the wash coating with 60% of the heat extracted from the metal stream, in spite of the fact that the ratio of heat of vaporization to heat of fusion of polystyrene is 10.9 (i.e. 876 Joules per gram/80.36 Joules per gram). The heat that is contained in the liquid that leaves through the wash coating increases to 63% if the heat of polymerization figure of 647 Joules per gram is used in the calculation instead of 876 Joules per gram figure (i.e. the heat of decomposition figure).

The experimental slope for polymethylmethacrylate (PMMA) is steeper than that for polystyrene, indicating that even more heat is extracted from the metal stream with PMMA. This is in agreement with the following thermodynamic data on PMMA:

Heat Capacity=2.05 Joules per gram per degrees C. (at 120° C.)

Heat of Polymerization=578 Joules per gram

Using an estimate for the heat of fusion of PMMA as 90 Joules per gram and the above data from the 1989 edition of the *Polymer Handbook*, the previous method of calculation would indicate that total heat extracted from an advancing metal stream by one cubic inch of PMMA is larger for PMMA than for polystyrene. This would mean that PMMA is less desirable as a foam material than polystyrene in a lost foam casting process. If polypropylene foam is used in the lost foam casting process, the thermodynamic properties of this high temperature material (i.e. melting temperature of 176° C., heat of fusion of 209 Joules per gram, heat capacity of 1.96 Joules per gram per degrees C. at 27° C. and 2.6 Joules per gram per degrees C. at 127° C.) indicate that the heat extracted from the metal stream just by the liquid phase would exceed the total heat extracted by the polystyrene (per 1 cubic inch of foam). Thus, the use of polypropylene in a lost foam casting process is unacceptable because of its high heat of fusion which is 160% higher than the heat of fusion for polystyrene.

Based on the above data which indicates that the liquified foam material that leaves the foam-filled cavity through the porous wash coat with as much as 60% of the heat extracted from the advancing metal stream it is reasonable to view the lost foam casting process as a quenching process with the foam as the quenching media. In this quenching process the severity of the quench is very much dependent on the thermodynamic properties of the foam material because initially the foam goes through a phase change from solid to liquid and then the liquid phase is heated. Unlike a conventional metal quenching process where the metal being quenched is in the solid state and supports its shape (even though distortion may be a concern), the material being quenched in a lost foam casting process is liquid metal which cannot support its shape effectively. Momentum effects (coupled with a stable liquid metal front) and a high-solid fraction at the eutectic temperature, provide hypoeutectic aluminum-silicon alloys with sufficient fluidity, so that loss of heat from the advancing metal front basically only causes misruns which can be mitigated by pouring at a higher temperature. However, with hypereutectic aluminum-silicon that inherently have a low volume fraction of solids at the eutectic temperature, the increased fluidity actually works against the making of defect-free castings when using polystyrene as the foam material, and allows the coexistence of immisible liquids that results in the partitioning of the liquid styrene to occur against the coating interface. The liquid aluminum alloy then freezes before the various isolated liquid styrene volume segments escape through the coating. This spacial distribution of the trapped liquid styrene is the spacial distribution of void space in the defective casting. This liquid styrene problem is unique to hypereutectic aluminum-silicon alloys, and the alloy does not respond favorably to increased pouring temperatures, unless the pouring temperature is increased to 1600° F. and above, where shrinkage becomes a severe problem.

Recognizing that the thermodynamic properties of the liquid polymer foam (i.e. the heat of fusion, the decomposition temperature, and heat of decomposition) have a most significant effect on the heat that is extracted from the molten metal stream, it has unexpectedly been discovered that polyalkylene carbonate [i.e. formula $(C_4H_6O_3)_x(C_7H_{10}O_8)_y$; CAS NOS. 25511–85–7] when used as the expanded foam material in a lost foam casting process for the casting of hypereutectic aluminum-silicon alloys, does not exhibit the defect associated with the trapped liquid polymer defect. Because the temperature loss from the molten metal stream has unexpectedly been observed to be markedly less than for the expanded polystyrene (of 1.6 lb./$ft^3$ density) it is reasoned that having a decomposition temperature less than 300° C. and a heat of decomposition less than 600 Joules per gram is very important.

The heat capacities for polystyrene and polyalkylene carbonate are quite similar and the two polymers should have similar enthalpy changes during the stage in the process that the liquid polymer is heated in the liquid state. The heat of fusion is important even through its enthalpy contribution associated with the change of state from solid to liquid is subordinate to the enthalpy change associated with heating liquid because it occurs first in the process. The importance of the heat of fusion as it effects a lost foam casting process has not been fully appreciated and is not obvious to one of average skill in the art. A low heat of fusion means that the solid phase is easily transformed to the liquid state at the coating interface, where a higher degree of fusion generally exists, and where the foam mass is most effectively removed from the foam-filled cavity. This is most critical for the stability of the metal front which tends to lead at the mid-section thickness of the foam and is retarded at the surface in contact with the coating. In essence, the liquid polymer that is pushed to the coating interface as the metal front advances has less of a chance of building up an inventory if the heat fusion of the polymer is low.

Activating the exiting mechanism for liquid foam to leave the foam-filled cavity by more easily allowing liquid to exit at the casting interface (i.e. by lowering the barrier to change solid polymer to liquid polymer) during the dynamic process that occurs as a metal front passes a point (in contact with foam and coating) during the lost foam casting process is most important. This discovery of one of the mechanisms that controls the liquid styrene defect clearly indicates the heat of fusion of the polymer when dealing with hypereutectic aluminum-silicon alloys is potentially more important than one would expect from its contribution in enthalpy calculations (i.e. in the total heat extracted from the metal stream). However, there are two other important material properties that influence the heat extracted from the metal stream. These are the decomposition temperature and the heat of decomposition of foam polymeric pattern.

Using Thermal Gravitational Analysis it has been found that the decomposition temperature for polyalkylene carbonate is 155.9° C. lower than the decomposition temperature for polystyrene,. The ONSET temperature for thermal decomposition is similarly 134° C. lower for polyalkylene carbonate. The results of Thermal Gravitational Analysis are as follows:

TABLE 1

Thermal Gravitational Analaysis (TGA) Results

| | Onset Decomposition Temperature, ° C. | Decomposition Temperature, ° C. (DTGA Peak Position) |
|---|---|---|
| Polystyrene | 370.4 (with $\sigma/\bar{x}$ = 8.1%; 7 measurements) | 410.8 (with $\sigma/\bar{x}$ = 8.1%; 7 measurements) |
| Polyalkylene Carbontate | 236.4 (with $\sigma/\bar{x}$ = 5.3%; 7 measurements) | 254.9 (with $\sigma/\bar{x}$ = 9.8%; 7 measurements) |
| Temperature Difference | 134 | 155.9 |

On the basis of one cubic inch of polystyrene which causes 444 Joules to be extracted from the metal stream, the 155.9° C. lower thermal decomposition temperature for polyalkylene carbonate means that approximately 28% less heat, or 124.4 Joules (i.e. 42 gm×1.9 J/gm ° C.×155.9° C.) less, would be extracted from the metal stream. Thus, a low decomposition temperature means some portion of the enthaphy characteristic of heating up the liquid polymer is eliminated.

Using Differential Scanning Calorimetry (DSC) the following results for polyalkylene carbonate were obtained:

| | |
|---|---|
| DSC ONSET Temperature = | 250.5° C. (with $\sigma/\bar{x}$ = 5.6%; 4 measurements) |
| HEAT OF DECOMPOSITION = | 483.8 Joules/gram (with $\sigma/\bar{x}$ = 15.4%; 4 measurements |
| DSC PEAK Temperature = | 285.3° C. (with $\sigma/\bar{x}$ = 3.0%; 4 measurements) |

The heat of decompostion for polystyrene (i.e. 876 J/g) is 81% greater than the heat of decomposition for polyalkylene carbonate. Based on one cubic inch of polystyrene which causes 444 Joules to be extracted from the metal stream, the lower heat of decomposition for polyalkylene carbonate means that approximately 10% less heat would be extracted from the metal stream. This figure, however, significantly increases if the gas fraction increases above 25%. Since the 75% liquid/25% gas distribution for polystyrene is not necessarily the distribution for polyalkylene carbonate, there is some uncertainty in the 10% figure. There is also an interplay between the early starting feature of a low heat of fusion and the heat of decomposition. If the early exiting mechanism is very effective then there will be less liquid polymer than can be decomposed (or vaporized). On the other hand, if the energy barrier from decomposition is low then even if the liquid survives to this stage, the heat extraction from the metal stream and the residence time for a reaction between the polymer and metal oxide both should be less. By contrast, if the heat of fusion and heat of decomposition are both high, then a high residence time is likely, providing time to create the "fold" defect. Since even under the best of conditions all of the liquid does not go through the wash coating on the pattern, it is believed a low heat of decomposition is of paramount importance in preventing "folds" in hypoeutectic aluminum-silicon alloys.

Based on the above findings, the invention is directed to an improved method of lost foam casting of aluminum-silicon alloys, and particularly hypereutectic aluminum-silicon alloys, utilizing a foam pattern having a decomposition temperature less than 300° C., and a heat of decomposition less than 600 Joules per gram. In addition, the foam pattern should have a low heat of fusion less than 60 Joules per gram, and generally in the range of 15 to 30 Joules per gram, and a heat capacity of less than 1.6 Joules per gram per degrees K. at 54° C. and less than 2.1 Joules per gram per degrees K. at 127° C. The bulk density of the foam pattern is not critical, and can be in the range of 1.0 pounds per cubic foot to 4.0 pounds per cubic foot. The preferred material to be used in forming the foam pattern is polyalkylene carbonate, such as described in U.S. Pat. Nos. 4,633,929 and 4,773,466. More specifically, U.S. Pat. No. 4,633,929 describes a method of producing polyethylene carbonate and polypropylene carbonate foam patterns, while U.S. Pat. No. 4,773,466 relates to polyalkylene carbonate foam patterns prepared from cyclopentane oxide, cyclohexane oxide, cycloheptene oxide or isobutylene oxide and carbon dioxide.

The foam pattern is produced by conventional injection molding techniques utilizing expanded beads of the polymeric material. The pattern is produced with a configuration substantially identical to the configuration of the part to be cast.

As in conventional lost foam casting, the pattern can be coated with a porous ceramic material which acts to prevent a metal/sand reaction and facilitates cleaning of the cast metal part.

In the casting procedure, the foam pattern is placed in an outer mold or flask, and an unbonded, generally inert, particulate material such as sand, is introduced into the mold to surround the pattern and fill any voids or cavities in the pattern. The sand can be silica sand or a sand of the type described in U.S. Pat. No. 5,355,930.

As described above, the invention has particular use in casting hypereutectic aluminum silicon alloys. Alloys of this type contain about 16% to 30% by weight of silicon, 0.3% to 1.5% by weight of magnesium, up to 4.5% by weight of copper, and the balance aluminum. The pattern can also be used in casting hypoeutectic aluminum-silicon alloys which contain 5% to 8% by weight silicon, 0.3% to 0.5% magnesium, up to 4.5% by weight of copper, and the balance aluminum.

In the casting process, the molten aluminum silicon alloy at a temperature below 1600° F., and generally at a temperature in the range of 1300° F. to 1400° F., is introduced through one or more sprues into the mold and into contact with the foam pattern. The heat of the molten metal will melt, vaporize, and decompose in various fractions the foam sprue as well as the pattern, and the resulting decomposition products pass through the porous ceramic coating on the pattern and into the interstices of the surrounding sand. The molten metal will occupy the void created by vaporization of the pattern to produce a cast metal article substantial identical in configuration to the pattern.

In the past, polystyrene has been the most common material used in producing foam patterns for use in lost foam casting. Typical polystyrene foam has a heat of fusion of approximately 80 Joules per gram, a heat capacity of 1.2 Joules per gram per degrees K. at 27° C., and 2 Joules per gram per degrees K. at 127° C., a decomposition temperature of 41 0C. a heat of decomposition of 876 Joules per gram, and has a bulk density of about 1.6 pounds per cubic foot. As previously noted, when using polystyrene foam patterns when casting hypereutectic aluminum silicon alloys, "liquid styrene defects" commonly occur as a result of trapping liquid foam transformation products in the casting. This occurs because the molten metal solidifies before the transformation products can exit the foam filled cavity boundaries. Subsequent continued heating of the trapped liquid foam by the hot solidified metal causes the liquid products to vaporize and leave a void. Also, if the liquid styrene cannot reach the coating interface before it transforms to a gas and before the molten metal solidifies, trapped spherically-shaped porosity can occur just beneath the casting surface.

Through the invention it has been discovered that the reason that the defects occur is due to the high heat of fusion, a high decomposition temperature and a high heat of decomposition of the polystyrene foam. As the polystyrene is heated and transforms from solid to liquid, it extracts substantial heat from the molten metal causing the metal, in some cases, to solidify prematurely, thus resulting in the "liquid styrene" defects.

It has been further discovered that the defects can be eliminated by utilizing a foam pattern having a decomposition temperature less than 300° C., and a heat of decomposition less than 60 Joules per gram, coupled with a low heat of fusion, below 60 Joules per gram, and a heat capacity less than 1.6 Joules per gram per degrees K. at 54° C. and less than 2.1 Joules per gram per degree K. at 1 27° C. The use of a foam of this type reduces the amount of heat extracted from the molten metal, and thus eliminates premature solidification of the metal, particularly in the far reaches of the pattern. Polyalkylene carbonate has thermodynamic properties within these limits so that less than 300 Joules of heat per cubic inch of polyalkylene carbonate are extracted from the molten metal stream. The result of having no trapped liquid polymer products in the solidified casting through use of a foam pattern, such as polyalkylene carbonate foam, was totally unexpected.

To show the advantages of the use of a foam pattern composed of polyalkylene carbonate as opposed to polystyrene, a casting system was produced for fatigue specimens in which the gating and fatigue specimen foam patterns were attached to a common sprue in a symmetrical fashion, with one group of foam patterns formed of polyalkylene carbonate, and a similar group of patterns of identical configuration and formed of polystyrene. The foam polyalkylene carbonate patterns had a heat of fusion of 20.4 Joules per gram and a heat capacity of 1.54 Joules per gram per degree K. at 54° C. and 2.01 Joules per gram per degree K. at 1 270C. a decomposition temperature of 254.90° C., a heat of decomposition of 483.8 Joules per gram, and a bulk density of 3.3 pounds per cubic foot, while the polystyrene patterns had a heat of fusion of 80.6 Joules per gram, and a heat capacity of 1.4 Joules per gram per degree K. at 54° C., and 2 Joules per gram per degree K. at 127° C. a decomposition temperature of 410.80C, a heat of decomposition of 876 Joules per gram, and a bulk density of 1.5 pounds per cubic foot.

In this test, a hypereutectic aluminum silicon alloy was utilized, composed of 18.9% by weight silicon, 0.6% by weight magnesium, 0.1 5% by weight copper, and 79.9% by weight aluminum. The molten alloy at a temperature of 1390° F. was fed to the sprue, and the heat of the molten metal decomposed the patterns with the molten metal occupying the void created by vaporization of the pattern materials to produce the cast specimens.

Through an analysis of the cast specimens, it was evident that the expanded polystyrene foam patterns did not fill out even though its density was 1.6 pounds per square foot, whereas the metal completely filled out the polyalkylene carbonate foam patterns even though the density of these patterns was 3.3 pounds per cubic foot. This test demonstrates that a polyalkylene carbonate foam pattern extracts a substantially lesser amount of heat from the molten metal than the polystyrene foam pattern, thus preventing premature solidification of the molten metal and eliminating entrapment of polymeric decomposition products in the solidified metal.

Through the invention, it has been unexpectedly discovered that the use of polymeric foam patterns having a decomposition temperature less than 300° C., and a heat of decomposition less than 600 Joules per gram, coupled with a heat of fusion less than 60 Joules per gram, and a heat capacity less than 1.6 Joules per gram per degree K. at 54° C. and less than 2.1 Joules per gram per degree K. at 127° C., such as polyalkylene carbonate foam, in lost foam casting of aluminum-silicon alloys will prevent the trapping of liquid polymer products in the casting and will also improve the fill rate. As a further advantage it has been found that the density of the polyalkylene carbonate foam pattern is not critical, so that higher density patterns can be employed which provide improved mechanical strength and integrity for the pattern in shipping and handling to avoid distortion and damage.

We claim:

1. A method of lost foam casting of aluminum-silicon alloys, comprising the steps of forming a pattern of expanded polymeric foam in the configuration of an article to be cast, said polymeric foam having a decomposition temperature less than 300° C., a heat of fusion less than 60 Joules per gram, and a heat of decomposition less than 600 Joules per gram, placing the pattern in a mold, filling the mold and the cavities in the pattern with a free flowing generally inert particulate material, and introducing a molten aluminum-silicon alloy into contact with the pattern with the heat of the molten metal acting to liquefy and vaporize the pattern and the molten metal filling the void created by vaporization of the pattern to provide a cast part substantially identical in configuration to said pattern.

2. The method of claim 1, wherein the polymeric foam is polyalkylene carbonate foam.

3. The method of claim 1, wherein the polymeric foam has a heat capacity of less than 1.6 Joules per gram per degree K. at 54° C. and less than 2.1 Joules per gram per degree K. at 127° C.

4. The method of claim 1, wherein said alloy is a hypereutectic aluminum-silicon alloy and comprises from 16% to 30% by weight of silicon, 0.3% to 1.5% by weight of magnesium, up to 4.5% copper, and the balance aluminum.

5. The method of claim 1, wherein the alloy is an hypoeutectic aluminum-silicon alloy comprising by weight from 5% to 8% silicon, 0.3% to 0.5% magnesium, up to 4.5% copper and the balance aluminum.

6. The method of claim 2, wherein said polyalkylene carbonate has a decomposition temperature of 254.9° C. and a heat of decomposition of 483.8 Joules per gram.

7. The method of claim 1, wherein said polymeric foam has a heat of fusion of 20.4 Joules per gram and a heat capacity of 1.54 Joules per gram per degree K. at 54° C. and 2.01 Joules per gram per degree K. at 127° C., and a bulk density in the range of 1 pound per cubic foot to 4.0 pounds per cubic foot.

8. The method of claim 2, wherein said polyalkylene carbonate has thermodynamic properties such that less than 300 Joules per cubic inch of polyalkylene carbonate are extracted from the molten metal stream.

9. The method of claim 6, wherein the polyalkylene carbonate foam pattern has a decomposition temperature less than 300° C. and a heat of decomposition less than 600 Joules per gram.

10. The method of claim 6, wherein the polyalkylene carbonate foam has a heat of fusion less than 60 Joules per gram and a heat capacity of less than 1.6 Joules per gram per degree K. at 54° C. and less than 2.1 Joules per gram per degree K. at 127° C.

11. The method of casting an engine block for a marine internal combustion engine, comprising the steps of forming a pattern of expanded polyalkylene carbonate foam in the configuration of an engine block, placing the pattern in an outer mold, filling the mold and cavities in the pattern with unbonded free flowing sand, and introducing a molten hypereutectic aluminum silicon alloy comprising 16% to 30% by weight of silicon, 0.3% to 1.5% by weight of magnesium, up to 4.5% copper and the balance aluminum into contact with the pattern with the heat of said molten alloy acting to liquify and vaporize the pattern, said molten metal filling the void created by vaporization of the pattern to provide a cast engine block substantially identical in configuration to said pattern.

12. The method of claim 11, wherein said polyalkylene carbonate is produced from carbon dioxide and a material selected from the group consisting of polyethylene oxide, polypropylene oxide, cyclopentene oxide, cyclohexane oxide, cycloheptene oxide, and isobutylene oxide.

* * * * *

UNITED STATES PATENT AND TRADEMARK OFFICE

CERTIFICATE OF CORRECTION

PATENT NO. : 5,960,851

DATED : October 5, 1999

INVENTOR(S) : Raymond J. Donahue and Terrance M. Cleary

It is certified that error appears in the above-indentified patent and that said Letters Patent is hereby corrected as shown below:

On the title page, Item [75] add Inventor:

--and Terrance M. Cleary, Fond du Lac, Wisconsin--.

Signed and Sealed this

Sixth Day of March, 2001

*Attest:*

Nicholas P. Godici

NICHOLAS P. GODICI

*Attesting Officer*

*Acting Director of the United States Patent and Trademark Office*